US005254816A

United States Patent [19]

Shutoh et al.

[11] Patent Number: 5,254,816

[45] Date of Patent: Oct. 19, 1993

[54] POWER CIRCUIT BREAKER AND POWER RESISTOR

[75] Inventors: Naoki Shutoh, Yokohama; Motomasa Imai, Tokyo; Fumio Ueno, Yokohama; Hideyasu Andoh, Tokyo; Shoji Kozuka, Kawasaki; Hiroshi Endo, Yokohama; Iwao Mitsuishi, Yokohama, all of Japan

[73] Assignee: Kabushiki Kaisha Toshiba, Kawasaki, Japan

[21] Appl. No.: 859,868

[22] Filed: Mar. 30, 1992

[30] Foreign Application Priority Data

Mar. 30, 1991 [JP] Japan ..... 3-93681
Mar. 12, 1992 [JP] Japan ..... 4-87574

[51] Int. Cl.[5] ..... H01C 7/10; H01H 33/16

[52] U.S. Cl. ..... 200/144 AP; 338/20; 338/21

[58] Field of Search ..... 200/144 AP, 148 R; 338/20, 21

[56] References Cited

U.S. PATENT DOCUMENTS

| | | | |
|---|---|---|---|
| 2,892,988 | 6/1959 | Schusterius . | |
| 4,169,071 | 9/1979 | Eda et al. | 252/517 |
| 4,730,179 | 3/1988 | Nakata et al. | 338/20 |
| 4,736,183 | 4/1988 | Yamazaki et al. | 338/20 |
| 4,855,708 | 8/1989 | Nakata et al. | 338/20 |
| 4,933,659 | 6/1990 | Imai et al. | 338/20 |
| 4,943,795 | 7/1990 | Yamazaki et al. | 338/21 |

FOREIGN PATENT DOCUMENTS

| | | |
|---|---|---|
| 0078418 | 5/1983 | European Pat. Off. . |
| 0172409 | 2/1986 | European Pat. Off. . |
| 0270119 | 6/1988 | European Pat. Off. . |
| 0357113 | 3/1990 | European Pat. Off. . |
| 58-139401 | 8/1983 | Japan . |
| 61-281510 | 12/1986 | Japan . |
| 63-90801 | 4/1988 | Japan . |

OTHER PUBLICATIONS

Solid-State Electronics, vol. 6, pp. 111-120, 1963, R. H. Pry, et al., "Positive Temperature Coefficient of Electrical Resistivity in Some ZnO—$TiO_2$—NiO Ceramics".

Derwent Publications Ltd., AN 91-060961, JP-A-03 008 767, Jan. 16, 1991.

Derwent Publications Ltd., An 82-22834E, JP-A-57 026 404, Feb. 12, 1982.

*Primary Examiner*—J. R. Scott

*Attorney, Agent, or Firm*—Oblon, Spivak, McClelland, Maier & Neustadt

[57] ABSTRACT

According to this invention, there is disclosed a compact power circuit breaker having a large breaking capacity and stable breaking performance due to a compact closing resistor unit having high performance. The power circuit breaker includes a main switching mechanism having an arc extinguishing function, an auxiliary switching mechanism parallelly connected to the main switching mechanism and having an arc extinguishing function, and a closing resistor unit connected in series with the auxiliary switching mechanism and incorporated with a resistor containing zinc oxide (ZnO) as a main component and titanium figured out as titanium oxide ($TiO_2$) in an amount of 0.5 to 25 mol% and nickel figured out as nickel oxide (NiO) in an amount of 0.5 to 30 mol. % as sub-components.

13 Claims, 7 Drawing Sheets

POWER CIRCUIT BREAKER AND POWER RESISTOR

BACKGROUND OF THE INVENTION

1. Field of the Invention

The present invention relates to a power circuit breaker and a power resistor suitable for absorbing a surge generated by power equipments such as a voltage transformer and a circuit breaker.

2. Description of the Related Art

A closing resistor is generally connected to a power circuit breaker parallelly to a breaking connection point to absorb a surge generated during a switching operation and to increase a breaking capacity. As a resistor used for the above purpose, a carbon grain dispersion ceramic resistor described in Published Unexamined Japanese Patent Application No. 58-139401 is conventionally used. This resistor is obtained by dispersing a conductive carbon powder in an insulating aluminum oxide crystal and sintering them by a clay. The resistor has a resistivity of 100 to 2,500 Ω.cm. The resistivity to the resistor can be advantageously changed by controlling the content of the carbon powder. However, since the resistor has low denseness, i.e., a porosity of 10 to 30%, the following problems are posed.

That is, since a heat capacity per unit volume is small, i.e., about 2 J/cm$^3$.deg, the temperature of the resistor is remarkably increased in accordance with heat generation caused by surge absorption. In addition, since a discharge is caused between carbon grains during absorption of a switching surge, or the resistor has a negative temperature coefficient of resistance, the resistor is easily punched through and broken, and an energy breakdown is decreased. In addition, when the resistor is exposed at a high temperature, carbon grains for controlling the resistance are oxidized. For this reason, the resistance is largely changed. Therefore, in the circuit breaker using a carbon grain dispersion ceramic resistor, a space for arranging the resistor is increased, and a breaking capacity must be suppressed to be small to secure the reliability of the circuit breaker.

In recent years, in accordance with an increase in capacity of a circuit breaker caused by the technical development, a high-performance closing resistor for absorbing a switching surge is strongly demanded. In order to cope with the above demand, a zinc oxide-aluminum oxide power resistor is disclosed in Published Unexamined Japanese Patent Application No. 61-281510, and a zinc oxide-magnesium oxide power resistor is disclosed in Published Unexamined Japanese Patent Application No. 63-55904. In these patent applications, the following advantages are described. That is, since each of these resistors has a relatively high surge breakdown and a positive temperature coefficient of resistance, the resistor has excellent characteristics, i.e., the resistor is not easily over run. However, each of the resistors is difficulty formed by a highly dense sintered body, and the production stability and the stability against a change in atmosphere, are not satisfied. In addition, a heat capacity per unit volume cannot be increased. As a result, in the circuit breaker using these resistors, a large space is required for arranging the resistor, and the breaking capacity must be suppressed to be small to secure the reliability of the circuit breaker.

In Solid-State Electronics Pergamon Press 6, 111 (1963), U.S. Pat. No. 2,892,988, U.S. Pat. No. 2,933,586, zinc oxide resistors are disclosed. In this publication, the resistivity of each of these zinc oxide resistors can be controlled within a wide range by changing contents of additives such as zinc oxide, nickel oxide (NiO), and titanium oxide ($TiO_2$) contained in a ceramic. In addition, a temperature coefficient of resistance can be changed within a range from a negative value to a positive value. However, the application and performance of the resistors which are used as power resistors are not disclosed, and the application of the resistors to a circuit breaker as a closing resistor is not disclosed.

SUMMARY OF THE INVENTION

It is an object of the present invention to provide a compact power circuit breaker having a large breaking capacity and stable breaking performance by using a compact closing resistor unit having high performance.

It is another object of the present invention to provide a power resistor which has a large heat capacity per unit volume, an appropriate resistivity, a positive temperature coefficient of resistance having a small absolute value, a small change in resistance with time caused by surge absorption.

According to the present invention, there is provided a power circuit breaker comprising:

main switching means having an arc extinguishing function;

auxiliary switching means parallelly connected to the main switching means and having an arc extinguishing function; and a closing resistor unit connected in series with the auxiliary switching means and incorporated with a resistor containing zinc oxide (ZnO) as a main component and titanium figured out as titanium oxide ($TiO_2$) in an amount of 0.5 to 25 mol. % and nickel figured out as nickel oxide (NiO) in an amount of 0.5 to 30 mol. % as sub-components.

A power circuit breaker according to the present invention will be described below with reference to the accompanying drawings.

FIG. 1 is a perspective view showing an arrangement of a circuit breaker according to the present invention, FIG. 2 is a perspective view showing a closing resistor. A circuit breaker 1 includes a main connection point 3 arranged in an arc extinguishing chamber 2 and connected to a main circuit. An auxiliary connection point 4 is connected to the main circuit parallelly with respect to the main connection point 3. A closing resistor unit 5 is connected in series with the auxiliary connection point 4. A switch 7 is arranged on an insulating operation rod 6. The switch 7 is connected to the auxiliary connection point 4 by the insulating operation rod 6 before the switch 7 is connected to the main connection point 3. A main switching mechanism having an arc extinguishing function is constituted by the main connection point 3, the insulating operation rod 6, and the switch 7. An auxiliary switching mechanism having an arc extinguishing function is constituted by the auxiliary connection point 4, the insulating operation rod 6, and the switch 7.

The closing resistor unit 5 is mainly constituted by an insulating support shaft 8, a pair of conductive support plates 9*a* and 9*b*, a plurality of hollow cylindrical resistors 10, and an elastic body 11, as shown in FIG. 2. The pair of conductive support plates 9*a* and 9*b* are fitted on the support shaft 8. The plurality of hollow cylindrical resistors 10 are fitted on the support shaft 8 between the support plates 9a and 9b. The elastic body 11 is disposed between the plurality of resistors 10 and the support plate 9a located at one end (right end). At the same time, the elastic body 11 is fitted on the support shaft 8. The elastic body 11 applies an elastic force to the plurality of resistors 10 and stacking them around the support shaft 8. Nuts 12a and 12b are threadably engaged with both the ends of the support shaft 8, respectively. The nuts 12a and 12b are used for pressing the elastic body 11 arranged between the support plates 9a and 9b. The insulating support shaft 8 is made of an organic material to have a high strength, a light weight, and good workability. The temperature of a closing resistor is generally increased during absorption of a switching surge. For this reason, the strength of the support shaft made of the organic material having a low heat resistance cannot easily be maintained. However, since a closing resistor having a composition (to be described later) has a large heat capacity, an increase in temperature of the resistor during absorption of a switching surge can be suppressed to a predetermined temperature or less. As a result, a support shaft made of the organic material can be available. In addition, as the heat capacity of a closing resistor is increased, the volume of the closing resistor can be decreased.

The resistor 10 incorporated in the closing resistor unit 5 is constituted by an annular sintered body 13, electrodes 14 formed on the upper and lower surfaces of the sintered body 13, and insulating layers 15 coated on the outer peripheral surface of the sintered body 13 and the inner peripheral surface of a hollow portion, as shown in FIGS. 3 and 4.

The sintered body 13 having a composition containing zinc oxide (ZnO) as a main component and containing titanium figured out as titanium oxide ($TiO_2$) in an amount of 0.5 to 25 mol. % and nickel figured out as nickel oxide (NiO) in an amount of 0.5 to 30 mol. %.

The electrodes 14 are preferably made of aluminum or nickel.

The insulating layers 15 are arranged to prevent a creepage discharge generated from the outer peripheral surface of the sintered body 13. The insulating layers 15 are preferably made of a resin, glass, or ceramic.

Each component ratio of the sintered body 13 constituting the resistor 10 is limited due to the following reason.

When the sintered body contains titanium figured out as titanium oxide ($TiO_2$) in an amount of less than 0.5 mol. %, a temperature coefficient of resistance has a negative value, and the absolute value of the temperature coefficient of resistance is increased. Therefore, a closing resistor having preferable characteristics cannot be obtained. On the other hand, when the sintered body contains titanium figured out as titanium oxide ($TiO_2$) in an amount of more than 25 mol. %, the resistivity is increased to $10^5$ Ω.cm or more, and a closing resistor having preferable characteristics cannot be obtained. An amount of titanium figured out as titanium oxide preferably falls within a range of 1 to 20 mol. %.

When the sintered body contains nickel figured out as nickel oxide (NiO) in an amount of less than 0.5 mol. %, the resistivity is about $10^2$ Ω.cm or less, a closing resistor having preferable characteristics cannot be obtained. On the other hand, when the sintered body contains nickel figured out as nickel oxide (NiO) in an amount of more than 30 mol. %, although a heat capacity per unit volume is increased, the resistivity is increased to $10^5$ Ω.cm or more, and a closing resistor having preferable characteristics cannot be obtained. An amount of nickel figured out as nickel oxide preferably falls within a range of 1 to 25 mol. %.

The resistor 10 is formed by the following method. A predetermined amount of titanium oxide powder and a predetermined amount of nickel oxide powder are added to a zinc oxide powder, and they are sufficiently mixed in a ball mill together with water. The resultant mixture is dried, added a binder, granulated, and molded by a metal mold to have an annular shape. The molded body is calcined by an electric furnace in the air at a temperature of 1,000° C. to 1,500° C. The upper and lower surfaces of the sintered body are polished, and electrodes made of aluminum or nickel are formed on the upper and lower surfaces by sputtering, flame spraying, and baking to obtain an oxide resistor. On the outer peripheral surface of the resistor and the inner peripheral surface of the hollow portion, resin or inorganic insulating layers (high-resistance layers) for preventing creepage discharge are formed by baking or flame spraying.

It is sufficient that the resistor basically contains the above constituent components, and the resistor may contain other additives as needed for manufacturing the resistor and improving the characteristics of the resistor. In addition, although the structure of the resistor preferably has a hollow cylindrical shape, the structure is not limited to this shape, and the structure preferably has a shape suitable for a space for accommodating the resistor of the circuit breaker. For example, as shown in FIG. 5, the resistor 16 may be constituted by a disk-like sintered body 17, electrodes 18 arranged on the upper and lower surfaces of the sintered body 17, and an insulating layer 19 covered on the outer peripheral surface of the sintered body 17.

As a resistor (power resistor), in addition to the resistor having the above arrangement, resistors respectively having the following arrangements (1) to (4) are permitted.

Power Resistor (1)

This power resistor includes a sintered body and electrodes formed on at least both end faces of the sintered body. The sintered body contains zinc oxide (ZnO) as a main component and titanium figured out as titanium oxide ($TiO_2$) in an amount of 0.5 to 25 mol. % and nickel figured out as nickel oxide (NiO) in an amount of 0.5 to 30 mol. % as sub-components and has a broken surface formed by grains having an average grain size of 3 to 15 μm. The grain structure is constituted by an aggregate of a plurality of grains.

The constituent components of the sintered body are limited because of the same reason as described in the above closing resistor. In addition, an amount of titanium figured out as titanium oxide preferably falls within a range of 1 to 20 mol. %, and an amount of nickel figured out as nickel oxide preferably falls within a range of 1 to 25 mol. %.

The broken surface of the sintered body has a fine-grain structure shown in FIG. 6. The average grain size of the grains is 3 to 15 μm. When the broken surface is mirror-polished by, e.g., a diamond slurry, and thermally etched, it is observed that the broken surface is constituted by fine grains having an average grain size of 0.2 to 2 μm. That is, the sintered body has a fine structure constituted by fine primary grains having an average grain size of 0.2 to 2 μm and secondary grains (aggregate) having an average grain size of 3 to 15 μm and obtained by aggregating the primary grains.

The average grain sizes of the primary grains and the secondary grains of the sintered body are measured by the following method. The broken and etched surfaces of the sintered body are observed with a scanning electron microscope, and these surfaces are photographed. An arbitrary frame is defined in each of the photographs. The total number of grains in the frame is preferably 500 or more for decreasing an error. The grains in the frame are counted. At this time, a grain overlapping the frame is counted as ½. The frame area of the photograph is calculated in a contraction scale, and the resultant value is divided by the total number of grains in the frame to obtain an average area per grain. An average diameter is calculated on the basis of the circle formula. The resultant value is subjected to Fruman's correction (average grain size = average diameter × 1.5) to determine an average grain size. Note that, in a sintered body having insufficient denseness, voids are counted as grains.

The average grain size of the grains on the broken surface of the sintered body is limited due to the following reasons. That is, when the average grain size of the grains is set to be less than 3 μm, the resistance of the resistor is too high to obtain a power resistor having preferable characteristics. On the other hand, when the grain size of the grains exceeds 15 μm, cracks easily occur by repetitive pulse applications, thereby increasing a rate of change in resistance.

The above power resistor is formed by, e.g., the following method.

A predetermined amount of titanium oxide powder and a predetermined amount of nickel oxide powder are added to a zinc oxide powder, and they are sufficiently mixed in a ball mill together with water. The resultant mixture is dried, added a binder, granulated, and molded. At this time, a molding pressure is preferably set to be 200 kg/cm$^2$ or more to increase the density of the sintered body. When the molding is performed at a pressure of less than 200 kg/cm$^2$, the relative density of the sintered body is not increased, and a heat capacity of the sintered body per unit volume may be decreased.

The molded body is calcined by an electric furnace or the like. This calcining is performed in an oxide atmosphere such as in the air or oxygen gas, and the calcining is preferably performed at a temperature of 1,000° C. to 1,500° C. When the calcining temperature is set to be less than 1,000° C., sintering is not performed, and the relative density may be low. As a result, the heat capacity of the resistor per unit volume is decreased, an energy breakdown may be decreased. On the other hand, when the calcining temperature exceeds 1,500° C., the component elements of the sintered body, especially a nickel component, is considerably evaporated. Since variations in composition caused by the evaporation are conspicuous near the surface of the sintered body, a resistivity distribution is formed inside the sintered body. When the sintered body absorbs an energy to generate heat, a temperature distribution is formed, and the sintered body may be broken by a thermal stress. In addition, when the calcining is performed at a temperature rise rate of 50° C./hr or more, a sintered body having the fine grain structure shown in FIG. 6 can be obtained. More specifically, the temperature rise rate is preferably set to be 70° C./hr or more, further preferably set to be 100° C./hr or more. When the temperature rise rate is set to be less than 50° C./hr, sintering is excessively performed, and fine primary grains cannot be easily formed in the sintered body. For example, only grains each having a grain size of 10 μm or more are formed. As a result, when the resistor made of this sintered body is repetitively used, the resistivity may be considerably decreased.

The upper and lower surfaces of the sintered body are polished, and electrodes made of aluminum or nickel are formed on the upper and lower surfaces by sputtering, flame spraying, and baking to obtain a resistor (an oxide resistor). On the outer peripheral surface of the resistor and the inner peripheral surface of the hollow portion, resin or inorganic insulating layers (high-resistance layers) for preventing creepage discharge generated from the side surfaces of the resistor are formed by baking, flame spraying, or the like.

Power Resistor (2)

This power resistor includes a sintered body and electrodes formed on at least the upper and lower end faces of the sintered body. The sintered body contains zinc oxide (ZnO) as a main component and titanium figured out as titanium oxide ($ZnO_2$) in an amount of 0.5 to 25 mol. % and nickel figured out as nickel oxide (NiO) in an amount of 0.5 to 30 mol. % as sub-components and has a surface formed by a Spinel phase of $(Zn_XNi_{1-X})_2TiO_4$ ($0 \leqq X \leqq 1$).

The constituent components of the sintered body are limited because of the same reason as described in the above closing resistor. In addition, an amount of titanium figured out as titanium oxide preferably falls within a range of 1 to 20 mol. %, and an amount of nickel figured out as nickel oxide preferably falls within a range of 1 to 25 mol. %.

When the above $ZnO$-$TiO_2$-$NiO$ sintered body is reacted in the air at a temperature of 1,050° C., it is known that the constituent phases of the sintered body are changed into a (ZnO-NiO) solid solution (to be referred to as a ZnO phase hereinafter) and a ($Zn_2TiO_4$-$Ni_2TiO_4$) solid solution (to be referred to as a Spinel phase hereinafter). These reactions are described in, e.g., J. Inorg. Nucl. Chem., 32, 3474 (1970). The Spinel phase of the constituent phases has a Spinel structure, and the Spinel phase produces a solid solution throughout the entire area of the sintered body. That is, when the solid solution is expressed by $(Zn_XNi_{1-X})_2TiO_4$, wherein X falls with in a range of $0 \leqq X \leqq 1$. The resistivity of the solid solution is higher than that of the solid solution having the ZnO phase.

In the sintered body, Ni may be dissolved in ZnO or ZnO and $Zn_2TiO_4$ to obtain a solid solution. The sintered body may contain 0.01 ppm. to 1% by weight of a halogen.

The power resistor is formed by, e.g., the following method.

A predetermined amount of titanium oxide powder and a predetermined amount of nickel oxide powder are added to a zinc oxide powder, and they are sufficiently mixed in a ball mill together with a predetermined amount of an aluminum nitrate aqueous solution diluted to have a predetermined concentration and water. The resultant mixture is dried, added a binder, granulated, and molded. At this time, a molding pressure is preferably set to be 200 kg/cm$^2$ or more as described in the power resistor (1).

The molded body is calcined by an electric furnace or the like. This calcining is performed in an oxide atmosphere such as in the air or oxygen gas, and the calcining is preferably performed at a temperature of 1,000° C. to 1,500° C.

After the calcining is performed in the air, when the sintered body is subjected to powder X-ray diffraction, the constituent phases of the surface have the spectra shown in FIG. 8, and the constituent phases inside the sintered body have the spectra shown in FIG. 9. The constituent phases of the surface have a ZnO phase (peaks (1) in FIGS. 8 and 9) smaller than that of the inner constituent phases, and only a Spinel phase (peaks (2) in FIGS. 8 and 9) cannot be formed on the surface. It is known that zinc oxide is sublimed at a temperature of 1,720° C. in the atmospheric pressure. However, when the calcining is performed within the above temperature range (1,000° to 1,500° C.), only magnesium oxide is slightly evaporated, the ZnO phase of the surface is slightly decreased compared with the inner ZnO phase as shown in FIG. 9. More specifically, when the molded body is calcined in a magnesium oxide powder, constituent phases are almost constituted by only the Spinel phase (peaks (2) in FIG. 10) on the surface of the sintered body as shown in the powder X-ray diffraction spectra of FIG. 10. This phenomenon is performed due to the following reasons. That is, when the molded body is covered with a magnesium oxide powder and calcined, an evaporated zinc oxide component and magnesium oxide are reacted with each other to produce an NaCl type or wurtzite type (ZnO-MgO) solid solution. For this reason, evaporation of the ZnO phase near the surface of the sintered body is promoted to eliminate the ZnO phase, and the surface layer of the sintered body is constituted by only the Spinel phase.

The upper and lower surfaces of the sintered body are polished, and electrodes made of aluminum or nickel are formed on the upper and lower surfaces by sputtering, flame spraying, and baking to obtain a linear oxide resistor. On the outer peripheral surface of the resistor and the inner peripheral surface of the hollow portion, resin or inorganic insulating layers (high-resistance layers) for preventing creepage discharge are formed by baking or flame spraying as needed.

Power Resistor (3)

This power resistor includes a sintered body and electrodes formed on at least upper and lower end faces of the sintered body, the sintered body containing zinc oxide (ZnO) as a main component and titanium figured out as titanium oxide ($TiO_2$) in an amount of 0.5 to 25 mol. % and nickel figured out as nickel oxide (NiO) in an amount of 0.5 to 30 mol. % as sub-components, the titanium figured out as titanium oxide ($TiO_2$) in an amount of 0.005 to 0.1 mol. % being dissolved in grains of the zinc oxide as a solid solution.

The constituent components of the sintered body are limited because of the same reason as described in the above closing resistor. In addition, an amount of titanium figured out as titanium oxide preferably falls within a range of 1 to 20 mol. %, and an amount of nickel figured out as nickel oxide preferably falls within a range of 1 to 25 mol. %.

The amount of Ti solid solution (figured out as $TiO_2$) to the ZnO grains is set within the above range because of the following reasons. When an amount of titanium-oxide solid solution is set to be less than 0.005 mol. %, the temperature coefficient of resistance of the power resistor has a negative value. On the other hand, when an amount of titanium-oxide solid solution exceeds 0.1 mol. %, a rate of change in resistance of the power resistor is increased. The amount of Ti solid solution (figured out as $TiO_2$) is more preferably set to be 0.01 to 0.08 mol. %.

In the sintered body, Ni may be dissolved in ZnO or ZnO and $Zn_2TiO_4$ to obtain a solid solution. The sintered body may contain 0.01 ppm. to 1% by weight of a halogen. The power resistor is formed by, e.g., the following method.

A predetermined amount of titanium oxide powder and a predetermined amount of nickel oxide powder are added to a zinc oxide powder, and they are sufficiently mixed and polished using zirconia balls as grinding media in a ball mill together with water. The resultant mixture is dried, added a binder, granulated, and molded. At this time, a molding pressure is preferably set to be 200 kg/cm$^2$ or more as described in the power resistor (1).

The molded body is calcined by an electric furnace or the like. This calcining is performed in an oxide atmosphere such as in the air or oxygen gas, and the calcining is preferably performed at a temperature of 1,000° C. to 1,500° C., more preferably, at a temperature of 1,300° C. to 1,500° C. In addition, the calcining is performed at a temperature rise rate of 50° C./hr to 200° C./hr. When the temperature reaches the maximum temperature, a temperature drop rate is set to be 20° C./hr to 300° C./hr. Thereafter, rapid cooling (cooling in a furnace) is preferably performed. In this calcining, a sintered body in which titanium figured out as titanium oxide ($TiO_2$) in an amount of 0.005 to 0.1 mol. % is dissolved in ZnO grains to obtain a solid solution can be obtained.

The upper and lower surfaces of the sintered body are polished, and electrodes made of aluminum or nickel are formed on the upper and lower surfaces by sputtering, flame spraying, and baking to obtain a linear oxide resistor. On the outer peripheral surface of the resistor and the inner peripheral surface of the hollow portion, resin or inorganic insulating layers (high-resistance layers) for preventing creepage discharge generated from the side surfaces of the resistor are formed by baking, flame spraying, or the like as needed.

Power Resistor (4)

This power resistor includes a sintered body and electrodes formed on at least upper and lower end faces of the sintered body, the sintered body containing zinc oxide (ZnO) as a main component, titanium figured out as titanium oxide ($TiO_2$) in an amount of 0.5 to 25 mol. % and nickel figured out as nickel oxide (NiO) in an amount of 0.5 to 30 mol. % as sub-components, and 0.01 ppm. to 1% by weight of a halogen, Ni being dissolved in Zn or ZnO and $Zn_2TiO_4$ as a solid solution.

The constituent components of the sintered body are limited because of the same reason as described in the above closing resistor. In addition, an amount of titanium figured out as titanium oxide preferably falls within a range of 1 to 20 mol. %, and an amount of nickel figured out as nickel oxide preferably falls within a range of 1 to 25 mol. %.

The halogen contained in the sintered body is added to have various forms. For example, halides or halogen oxides of metal elements, i.e., Zn, Ni, Ti, and the like such as $ZnF_2$, $ZnCl_2$, $BnBr_2$, $ZnI_2$, $NiF_2$, $NiCl_2.6H_2O$, $TiF_4$, $TiOF_2$, $AlF_3$, and AlOF; a hydrogen halide such as HF, HCl, HBr, HI or solutions thereof; organic or inorganic compounds containing halogen elements such as $SOCl_2$ and $NH_4HF_2$; or halogen substances can be used as the halogen additives.

When a halide is added, an amount, of halide larger than the final content (0.01 ppm. to 1% by weight) is preferably set in consideration of evaporation of the halide in the calcining operation.

The amount of halogen contained in the sintered body is limited due to the following reasons. That is, when the halogen content is set to be less than 0.01 ppm., a decrease in resistivity caused by Ni evaporation in the calcining step cannot be compensated. On the other hand, when the halogen content exceeds 1% by weight, a highly dense sintered body cannot be obtained, and an element resistance is increased. Therefore, a power resistor having preferable characteristics cannot be obtained.

The power resistor is manufactured by, e.g., the following method.

A halogen compound or a halogen element is slightly added as a halogen supply source to a powder mixture made of a nickel oxide powder, a titanium oxide powder, and a zinc oxide powder, and the mixture is sufficiently mixed in a ball mill together with water. The resultant mixture is dried, added a binder, granulated, and molded. At this time, a molding pressure is preferably set to be 200 kg/cm$^2$ or more as described in the power resistor (1). The molded body is calcined by an electric furnace or the like. This calcining is preferably performed in an oxide atmosphere such as in the air or oxygen gas at a temperature of 1,000° C. to 1,500° C., as described in the power resistor (1).

The upper and lower surfaces of the sintered body are polished, and electrodes made of aluminum or nickel are formed on the upper and lower surfaces by sputtering, flame spraying, and baking to obtain a linear oxide resistor. On the outer peripheral surface of the resistor and the inner peripheral surface of the hollow portion, resin or inorganic insulating layers (high-resistance layers) for preventing creepage discharge generated from the side surfaces of the resistor are formed by baking, flame spraying, or the like as needed.

In manufacturing of the above resistors, Al may be added in the form of an aluminum nitrate aqueous solution during the source mixing operation.

A power circuit breaker according to the present invention includes a closing resistor unit incorporated with a sintered body containing zinc oxide (ZnO) as a main component and titanium figured out as titanium oxide ($TiO_2$) in an amount of 0.5 to 25 mol. % and nickel figured out as nickel oxide (NiO) in an amount of 0.5 to 30 mol. % as sub components. For this reason, when the resistor including a sintered body having the above composition is used, a compact high-performance closing resistor unit can be obtained, and an increase in breaking capacity, the stabilization of breaking performance, and a compact circuit breaker can be achieved.

The power resistor (1) according to the present invention includes a sintered body and electrodes formed on at least both end faces of the sintered body. The sintered body contains zinc oxide (ZnO) as a main component and titanium figured out as titanium oxide ($TiO_2$) in an amount of 0.5 to 25 mol. % and nickel figured out as nickel oxide (NiO) in an amount of 0.5 to 30 mol. % as sub-components and has a broken surface formed by grains having an average grain size of 3 to 15 μm. A grain structure is constituted by an aggregate of a plurality of grains. In the resistor, a heat capacity per unit volume can be increased, the resistivity can be set within an appropriate range, and the absolute value of a temperature coefficient of resistance can be decreased. In addition, a change in resistivity with time caused by surge absorption can be suppressed.

That is, the circuit breaker in out-of-phase conditions is closed, an energy of several 1000 kJ is injected into the resistor incorporated in the circuit breaker at a moment (about 0.01 second), and the temperature of the resistor is increased by 100° C. or more. As a result, a thermal stress is generated in the resistor. Since a conventional zinc-oxide resistor and a carbon grain dispersion ceramic resistor have a high dielectric breakdown of about 500 to 800 J/cm$^3$ and a high dielectric breakdown of 400 J/cm$^3$, respectively, these resistors are not broken. However, the sintered body of each of these resistors is constituted by only primary grains each having a size of about 10 μm, cracks occur in the grains of the sintered body and in grain boundary by the thermal stress, and the cracks extend. When a cycle of heating and cooling processes is repeated, the cracks further extend, and the surface area of the sintered body is increased. The surface resistor of each of the conventional resistors has a volume resistivity which is decreased as an applied electric field is increased. For this reason, as shown in FIG. 11 showing the characteristic curve B representing a relationship between the number of times of closing and a rate of change in resistivity, the resistivity is decreased in accordance with an increase in the number of times of closing by an increase in surface area.

As described above, in the power resistor (1) according to the present invention, the sintered body having the above composition has a broken surface constituted by grains (secondary grains) having an average grain size of 3 to 15 μm and a fine structure constituted by an aggregate of a plurality of primary grains. For this reason, even when cracks occur due to the thermal stress, the extension of the cracks can be prevented by the grain boundary of the fine primary grains. As a result, as shown in the curve A of FIG. 11, a decrease in resistivity in accordance with an increase in the number of times of closing can be considerably suppressed. In addition, the fracture toughness value of the resistor can be increased due the fine structure. Therefore, a power resistor having a large heat capacity per unit volume, a resistivity set within an appropriate range, a temperature coefficient of resistance having a small absolute value, and a suppressed change in resistivity with time can be obtained.

The power resistor (2) according to the present invention includes a sintered body and electrodes formed on at least the upper and lower end faces of the sintered body. The sintered body contains zinc oxide (ZnO) as a main component and titanium figured out as titanium oxide ($TiO_2$) in an amount of 0.5 to 25 mol. % and nickel figured out as nickel oxide (NiO) in an amount of 0.5 to 30 mol. % as sub-components and has a surface formed by a Spinel phase of $(Zn_xNi_{1-x})_2TiO_4$ ($0 \leqq X \leqq 1$). For this reason, the surface resistance of the resistor can be increased, and a creepage discharge can be suppressed. In addition, a heat capacity per unit volume can be increased. The resistivity can be set within an appropriate range, the absolute value of a temperature coefficient of resistance can be decreased, and a change in resistance with time caused by surge absorption can be suppressed.

The power resistor (3) according to the present invention includes a sintered body and electrodes formed on at least upper and lower end faces of the sintered body, the sintered body containing zinc oxide (ZnO) as a main component and titanium figured out as titanium oxide ($TiO_2$) in an amount of 0.5 to 25 mol. % and nickel figured out as nickel oxide (NiO) in an amount of 0.5 to 30 mol. % as sub-components, the titanium figured out as titanium oxide ($TiO_2$) in an amount of 0.005 to 0.1 mol. % being dissolved in grains of the zinc oxide as a solid solution. For this reason, a heat capacity per unit volume can be increased, a temperature coefficient of resistance has a positive value and an absolute value which can be decreased, and a change in resistance with time caused by surge absorption can be decreased.

In addition, the power resistor (4) according to the present invention includes a sintered body and electrodes formed on at least upper and lower end faces of the sintered body, the sintered body containing zinc oxide (ZnO) as a main component, titanium figured out as titanium oxide ($TiO_2$) in an amount of 0.5 to 25 mol. % and nickel figured out as nickel oxide (NiO) in an amount of 0.5 to 30 mol. % as sub-components, and 0.01 ppm. to 1% by weight of a halogen, Ni being dissolved in ZnO or ZnO and $Zn_2TiO_4$ as a solid solution. For this reason, a decrease in resistivity near the surface caused by Ni evaporation can be compensated by an increase in resistivity caused by halogen evaporation, thereby preventing variations in resistivity. As a result, thermal shock breakdown or generation of a creepage discharge in an ON state can be considerably decreased, and the reliability of the resistor can be remarkably improved.

That is, when the inventors variously examined a breakdown phenomenon and a creepage short-circuit phenomenon when instantaneous high power was applied to a resistor having a sintered body obtained such that Ni was dissolved in ZnO or ZnO and $Zn_2TiO_4$ to obtain a solid solution, it was found that these phenomena were caused by variations in resistivity of the sintered body. In addition, the inventors found a reason for the variations in resistivity of the sintered body. That is, nickel serving as a component of the sintered body was evaporated from the surface thereof during the calcining operation to cause variations in nickel concentration. It is understood that this is caused by the following phenomena.

Near the surface of the sintered body, a nickel concentration per unit volume estimated by the mixing ratio of the powders before the calcining operation is lower than an actual nickel concentration. A portion near the surface has a resistivity lower than that of an inner portion of the sintered body. For this reason, a current density near the surface of the sintered body is higher than that of an inner portion of the sintered body. As a result, heat is locally generated, and the sintered body is broken due to thermal shock.

In addition, the following is understood. Since a low-resistance layer is formed near the surface of the sintered body, a current flows along the surface, a creepage discharge is generated by operating the current as a trigger, and the function of the resistor is degraded.

In the above circumstances, a decrease in calcining temperature was tried to suppress evaporation of the nickel component from the sintered body surface. However, when the calcining temperature is decreased, a highly dense sintered body cannot be easily obtained.

The inventors formed a sintered body to prevent a decrease in resistivity of the surface portion of the sintered body as follows. The sintered body contained ZnO, $TiO_2$, and NiO at a predetermined mixing ratio, Ni was dissolved in the ZnO or the ZnO and $Zn_2TiO_4$ as a solid solution, and the sintered body contained 0.01 ppm. to 1% by weight of a halogen. As a result, the present inventors found that the resistivity of the surface portion could be uniformed by the structure to be described below.

When a powder mixture of a zinc oxide powder and a nickel oxide powder is calcined while a halide is slightly added to the mixture, although the resistivity near the surface is decreased by evaporation of nickel, the halide is also evaporated, and the resistivity of a portion from which the halide is evaporated is increased. That is, a decrease in resistivity near the surface caused by the nickel evaporation can be compensated by an increase in resistivity caused by the evaporation of halide. For this reason, local variations in surface resistivity of the sintered body can be prevented. As a result, thermal shock breakdown or generation of a creepage discharge in an ON state can be considerably decreased, and the reliability of the resistor can be remarkably improved.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

Figure 6:
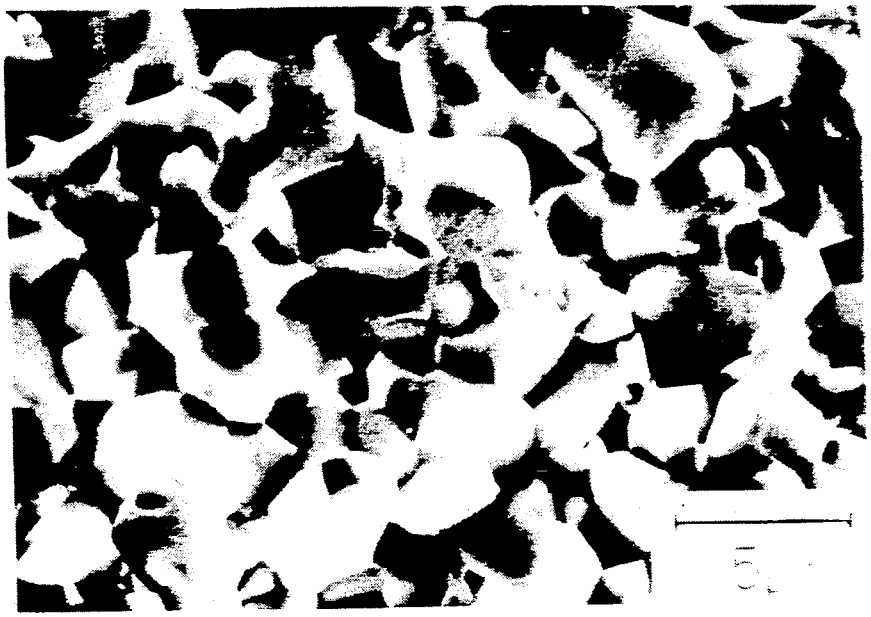
Figure 7:
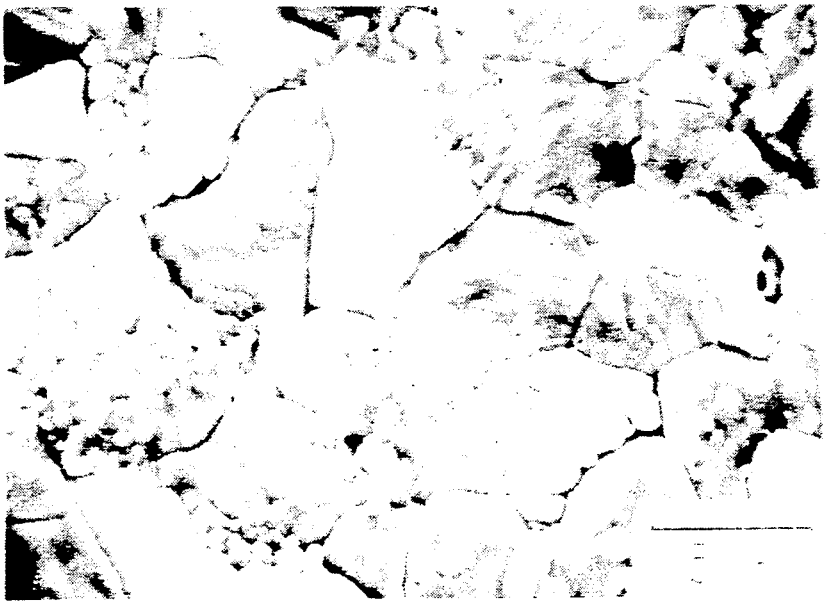
Figure 8:
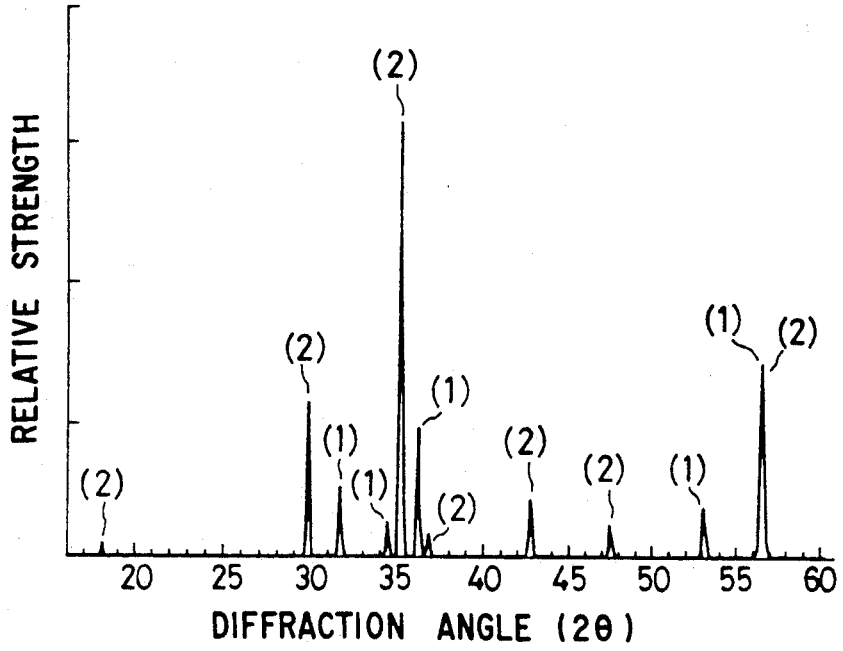
Figure 9:
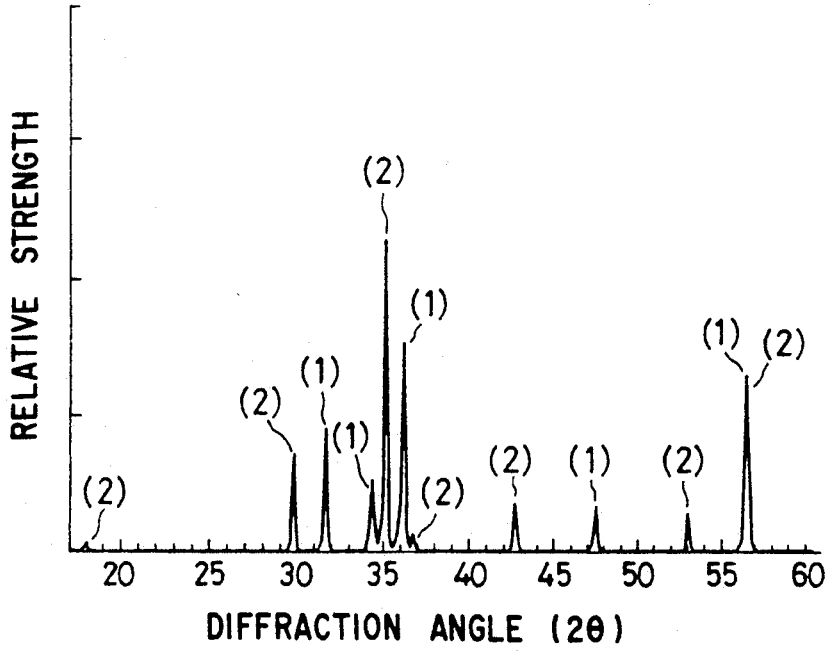
Figure 10:
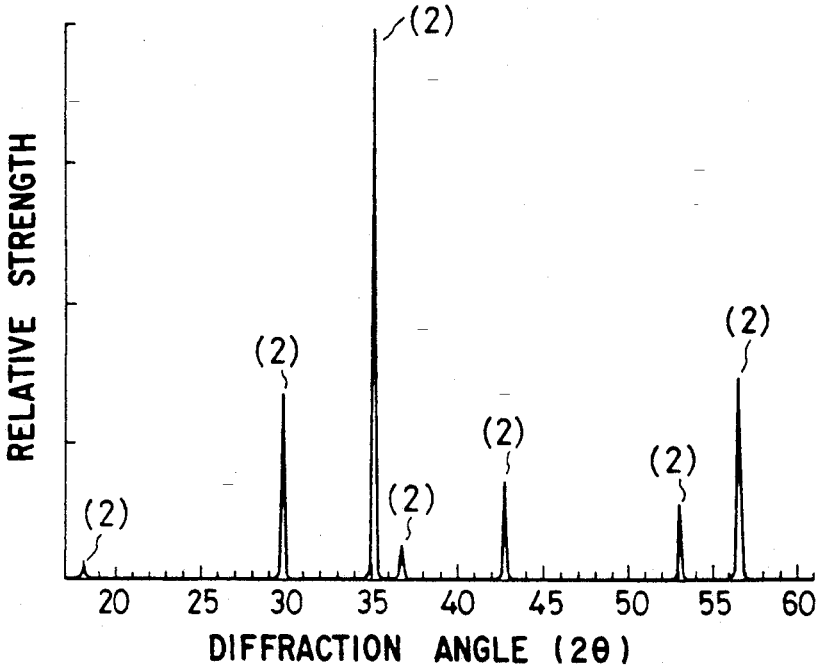
Figure 11:
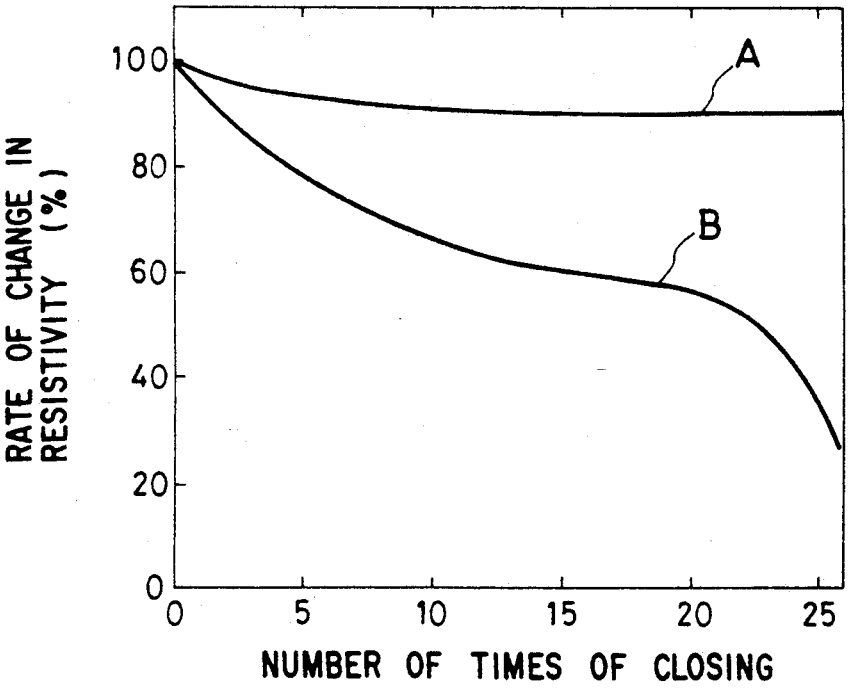
Figure 12:
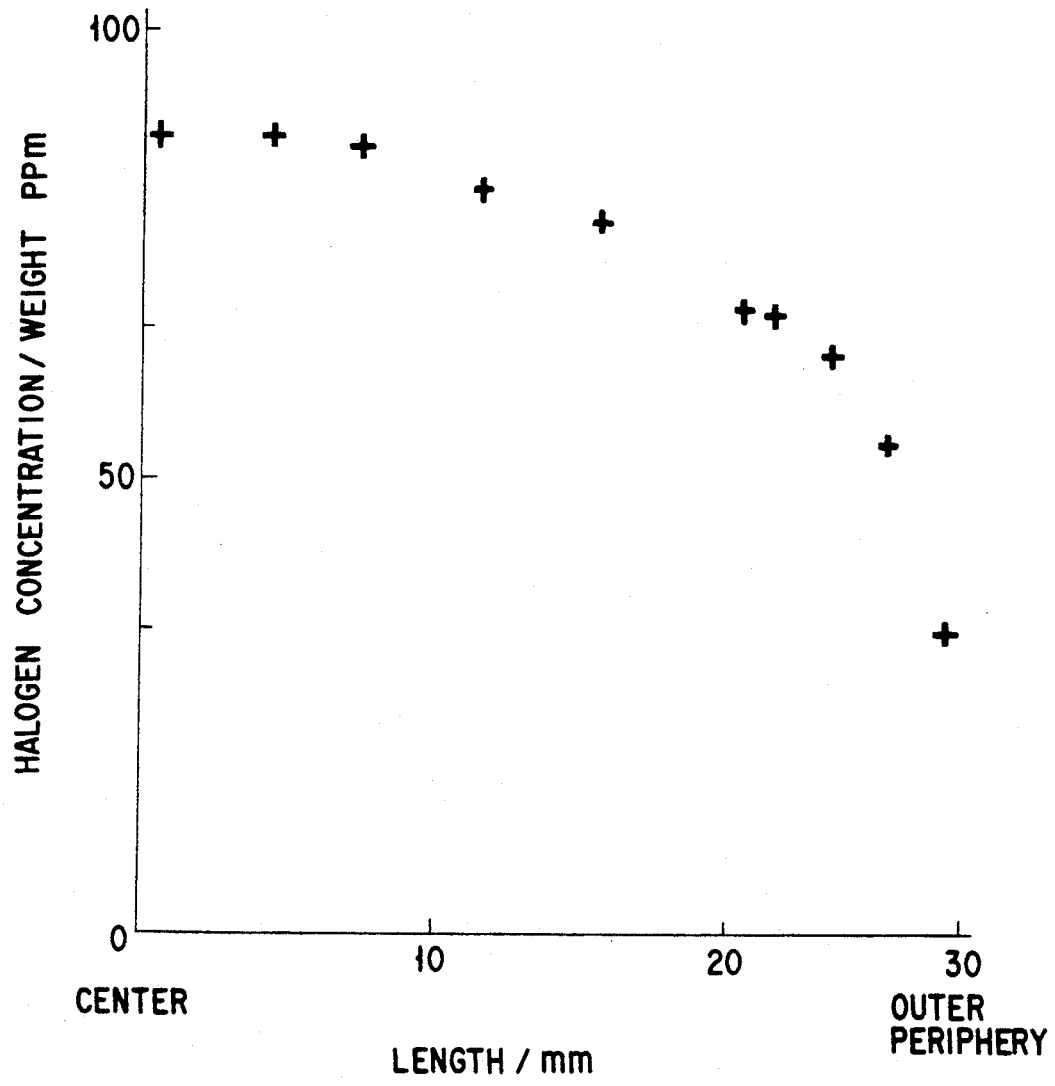

is a sectional view showing an another power resistor according to the present invention;

FIG. 6 is a photograph of a scanning electron microscope, showing a grain structure of the broken surface of a power resistor (1) according to the present invention;

FIG. 7 is a photograph of a scanning electron microscope, showing a grain structure of a surface obtained by thermally etching the broken surface of the power resistor (1) according to the present invention;

FIG. 8 is a powder X-ray diffraction spectrum chart of the inside of a zinc-oxide group sintered body;

FIG. 9 is a powder X-ray diffraction spectrum chart of the surface, of a zinc-oxide group sintered body;

FIG. 10 is a powder X-ray diffraction spectrum chart of a sintered body surface used in the power resistor (2) according to the present invention;

FIG. 11 is a graph showing a relationship between the number of times of closing of an electric field and a rate of change in resistivity of a resistor in the power resistor (1) of the present invention and a conventional resistor; and FIG. 12 is a graph showing concentration distributions of halogens in Example 26 and Comparative Example 2.

DETAILED DESCRIPTION OF THE PREFERRED EMBODIMENTS

The preferable examples of the present invention will be described below.

EXAMPLE 1

Figure 3:
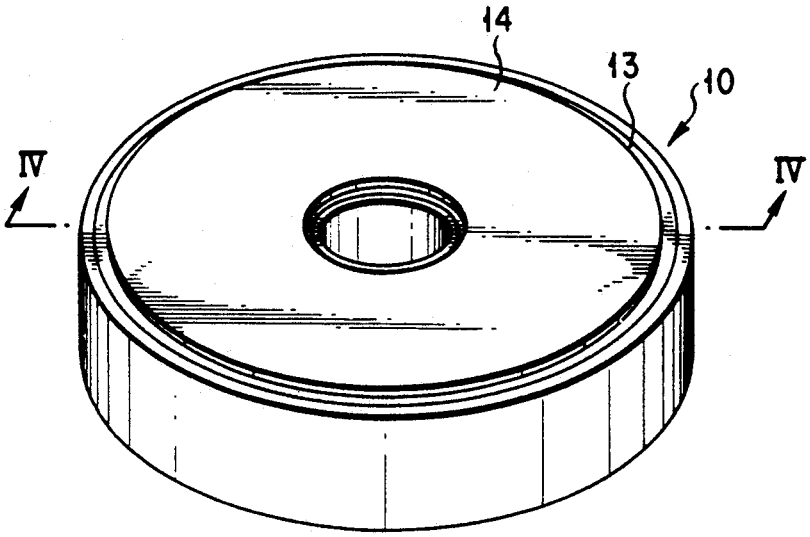
FIG. 3 is a perspective view showing a resistor incorporated in the closing resistor unit of the present invention.
Figure 4:
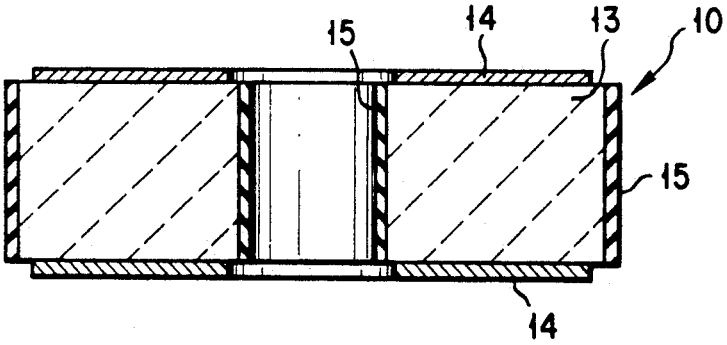
FIG. 4 is a sectional view showing the resistor along a line IV—IV in FIG. 3.

A zinc oxide (ZnO) powder having an average grain size of 0.2 μm, a nickel oxide (NiO) powder having an average grain size of 0.4 μm, and an anatase titanium oxide ($TiO_2$) powder having an average grain size of 0.2 μm were weighed at a mol rate of ZnO : NiO : $TiO_2$: 75 : 15 : 10. A binder was added to the source powders, and the powders were mixed in a wet state for 24 hours and then dried and granulated by spray-dry method. The granulated powder was molded by a metal mold at a pressure of 500 kg/cm$^3$ to form an annular molded body having an outer diameter of 140 mm, an inner diameter of 40 mm, and a height of 30 mm. The molded body was kept at a temperature of 1,300° C. in the air for 2 hours to be calcined. The sintered body had an outer diameter of 120 mm, an inner diameter of 35 mm, and a height of 25 mm. On the outer peripheral surface of the sintered body and the inner peripheral surface of the hollow portion of the sintered body, a borosilicate glass powder was coated and baked to form insulating layers. Thereafter, upper and lower surfaces of the sintered body were polished. After the sintered body was washed, aluminum electrodes were formed on the upper and lower surfaces by flame spraying, thereby manufacturing a resistor 10 shown in FIGS. 3 and 4.

In the resultant resistor, a relative density, a resistivity at room temperature, a temperature coefficient of resistance, a heat capacity, and energy breakdown were examined. Note that the density was measured by the Archimedean principle. The resistivity and the temperature coefficient of resistance were measured by a pseudo 4-terminal method such that small pieces each having a diameter of 10 mm and a thickness of 1 mm were cut from an outer surface, a central portion, and portions corresponding the center of the upper and lower surfaces and aluminum electrodes were formed on both the sides of each of the pieces. The temperature coefficient of resistance was calculated by a rate of change per 1° C. in resistivity at room temperature and in resistivity at a temperature of 100° C. As a result, the relative density of 98.0%, the resistivity of 730 Ω.cm±20 Ω.cm, the temperature coefficient of resistance of +0.38%/deg, the heat capacity of 2.90 J/cc.deg, and the energy breakdown of 780 J/cm$^3$ were obtained.

Figure 1:
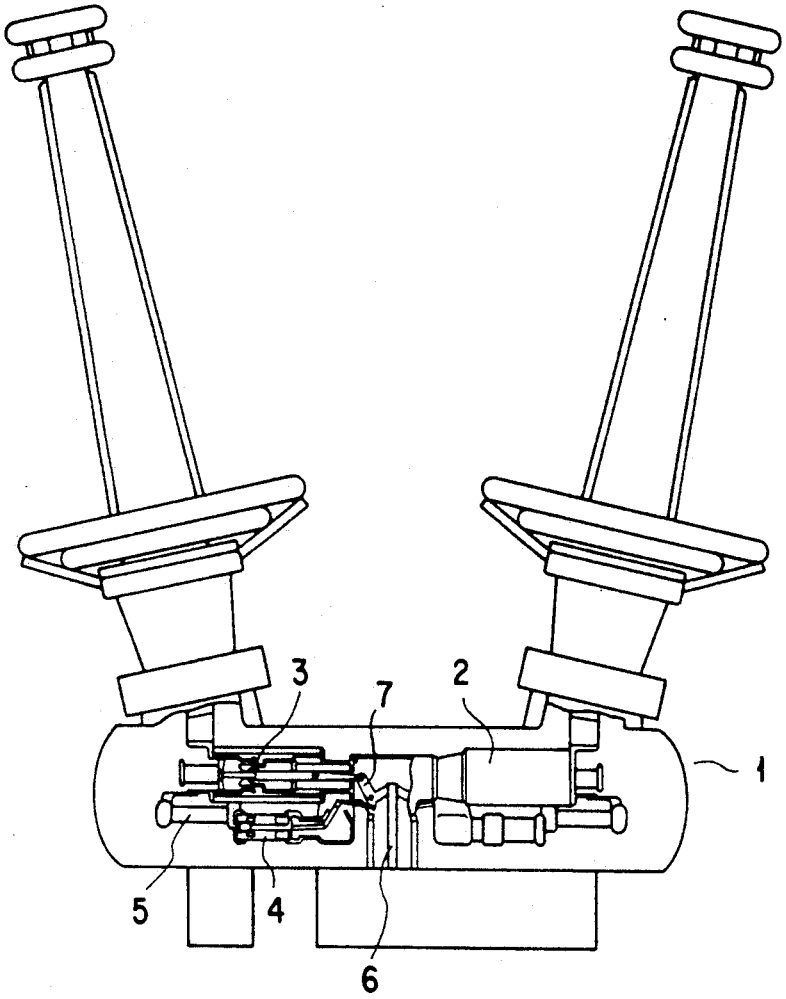
FIG. 1 is a view showing an arrangement of a circuit breaker according to the present invention.
Figure 2:
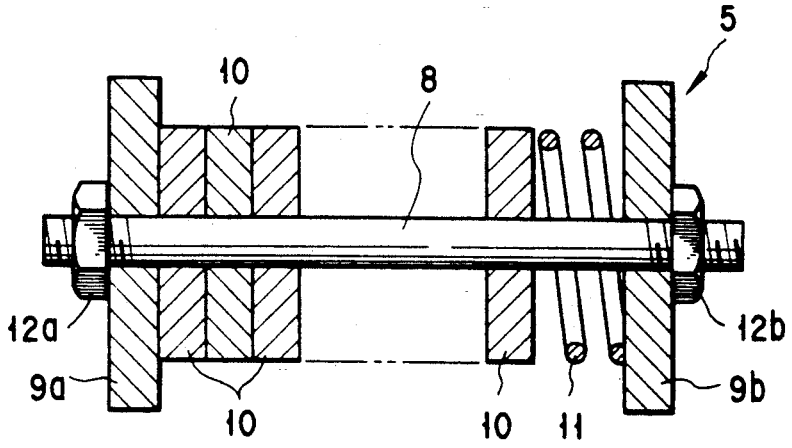
FIG. 2 is a view showing an arrangement of a closing resistor unit serving as a constituent element of the circuit breaker of the present invention.

A predetermined number of the resistors 10 were stacked as shown in FIG. 2, and the resistors 10 were supported by an insulating support shaft 8 made of a resin and extending through the centers of the resistors 10 and an elastic member 11. The resultant structure was accommodated in a cylindrical vessel to obtain a closing resistor unit 5. The closing resistor unit was incorporated as shown in FIG. 1 to assemble a power circuit breaker 1.

The circuit breaker of Example 1 was compared with a circuit breaker which had the same rated voltage as that of the circuit breaker of Example 1 and in which a closing resistor unit having a resistor using a conventional carbon grain dispersion ceramic body as a sintered body was incorporated. As a result, the volume of the circuit breaker of Example 1 was considerably decreased compared with the conventional circuit breaker, i.e., a reduction ratio of 90% could be obtained. In addition, in order to examine the stability of the breaking performance, an energy corresponding the energy of the circuit breaker in out-of-phase conditions was applied to the circuit breaker 20 times, a rate of change in resistivity of the closing resistor was examined. As a result, the rate of change was 10% or less, sufficiently high stability could be obtained.

EXAMPLES 2-12

A mixing ratio of a zinc oxide (ZnO) powder having an average grain size of 0.2 μm, a nickel oxide (NiO) powder having an average grain size of 0.4 μm, and an anatase titanium oxide ($TiO_2$) powder having an average grain size of 0.2 μm was changed as shown in Table 1, and 11 types of resistors having sintered bodies of various compositions were manufactured. When these resistors were incorporated in circuit breakers as in Example 1, energy breakdown and a volume reduction ratio of each of the circuit breakers were examined. The obtained results are summarized in Table 1.

TABLE 1

| | ZnO mol % | NiO mol % | $TiO_2$ mol % | Energy Breakdown of Resistor J/cm$^3$ | Reduction Ratio of Volume of Circuit Breaker % |
|---|---|---|---|---|---|
| Example 2 | 99 | 0.5 | 0.5 | 740 | 90.5 |
| Example 3 | 90 | 5 | 5 | 750 | 90.4 |
| Example 4 | 85 | 10 | 5 | 770 | 90.2 |
| Example 5 | 80 | 15 | 5 | 780 | 90.0 |
| Example 6 | 75 | 20 | 5 | 790 | 89.8 |
| Example 7 | 70 | 25 | 5 | 810 | 89.7 |
| Example 8 | 65 | 30 | 5 | 820 | 89.5 |
| Example 9 | 85 | 5 | 10 | 750 | 90.3 |
| Example 10 | 80 | 10 | 10 | 770 | 90.2 |
| Example 11 | 70 | 20 | 10 | 790 | 89.8 |
| Example 12 | 80 | 5 | 15 | 760 | 90.3 |

In the circuit breakers of Examples 2 to 12, as in Example 1, when an energy corresponding the energy of the circuit breaker in out-of-phase conditions was applied to each of the circuit breakers 20 times, stability of each of the breakers was examined. As a result, a rate of change in resistivity of each closing resistor unit was 10% or less.

EXAMPLE 13

A zinc oxide (ZnO) powder having an average grain size of 0.2 μm, a nickel oxide (NiO) powder having an average grain size of 0.4 μm, and an anatase titanium oxide ($TiO_2$) powder having an average grain size of 0.2 μm were weighed at a mol rate of ZnO : NiO : $TiO_2$=75 : 15 : 10. The source powders were mixed in a wet state for 24 hours together with distilled water by a zirconia ball mill. The distilled water was removed, and the resultant powder mixture was screened. Thereafter, 7 wt. % of a 5% PVA aqueous solution were added to the powder mixture, and the powder mixture was screened again to form a granulated powder. This granulated powder was molded by a metal mold at a pressure of 500 kg/cm$^2$ to obtain a disk-like molded body having a diameter of 140 mm and a height of 30 mm.

This molded body was heated at a temperature of 500° C. in the air for 24 hours to remove a binder, thereby obtaining a degreased body. The degreased body was placed in a box formed by a magnesium oxide sintered body and was calcined in the air. As a temperature profile, a temperature was increased at a rate of 100° C./hour, a temperature of 1,300° C. was kept for 2 hours, and the temperature was decreased to room temperature at a rate of 100° C./hour. The sintered body had a diameter of 120 mm and a height of 25 mm.

The sintered body was mechanically broken, the broken surface of the sintered body was mirror-polished, and the broken surface was thermally etched at a temperature of 1,100° C. for 30 minutes. As a result, the primary grains of the sintered body had an average grain size of 0.4 μm, and the secondary grains had an average grain size of 8 μm.

After the outer peripheral surface of the sintered body was coated with a borosilicate glass powder, the powder was baked to form an insulating layer. Thereafter, the upper and lower surfaces of the sintered body were polished. After the sintered body was washed, aluminum electrodes were formed on the upper and lower surfaces by flame spraying, thereby manufacturing the resistor shown in FIG. 5.

In the resistor of Example 13, a relative density was 98.0%, a resistivity at room temperature was 730 Ω.cm±20 Ω.cm, a resistance was 16.4±0.5 Ω, a temperature coefficient of resistance was +0.38%/deg, a heat capacity was 2.90±0.4 J/cc.deg, and an energy breakdown was 780 J/cm$^3$.

The resistor was used as a closing resistor of a circuit breaker, and the circuit breaker in out-of-phase conditions were closed. At this time, an energy was injected into the closing resistor, and the temperature of the resistor was increased. When an energy of 230 J/cm$^3$ was applied to the resistor of Example 13, the increase in temperature could be suppressed within 80° C. In addition, the energy injection (230 J/cm$^3$) was repeated 20 times. As a result, a resistivity of 660 Ω.cm±30 Ω.cm was obtained, and the resistivity of the resistor before application was changed with a very small rate of change, i.e., about 10%.

COMPARATIVE EXAMPLE 1

A conventional carbon grain dispersion ceramic resistor (a resistivity of 500 Ω.cm at room temperature, a resistance of 11.4 Ω, and a heat capacity of 2.0 J/cm$^3$.deg) was used as a closing resistor of a circuit breaker as in Example 13. The resistor of the circuit breaker in out-of-phase conditions was closed, a maximum energy which could be injected into the resistor when an increase in temperature of the resistor was suppressed within 80° C. was measured. As a result, the energy of 160 J/cm$^3$ was obtained, and this value was only 70% the energy obtained by the resistor of Example 13. Therefore, the volume of the closing resistor in Comparative Example 1 must be 1.5 times that of the closing resistor of Example 13. Since the volume of the resistor was increased, the breaker of Comparative Example 1 must be larger than that of Example 13 as follows. That is, a volume was 1.3 times, a installation area was 1.1 times, and the weight was 1.2 times.

EXAMPLE 14-24

A mixing ratio of a zinc oxide (ZnO) powder having an average grain size of 0.2 μm, a nickel oxide (NiO) powder having an average grain size of 0.4 μm, and an anatase titanium oxide ($TiO_2$) powder having an average size of 0.2 μm was changed as shown in Table 2, and 11 types of resistors having sintered bodies of various compositions were manufactured.

The various characteristics of the resistors of Examples 14 to 24 were measured. The resultant values are shown in Table 3. Note that, in Table 13, rates of changes in resistance are values obtained after absorption of an energy of 230 J/cm$^3$ is repeated 20 times.

TABLE 2

| | Content of ZnO mol % | Content of NiO mol % | Content of $TiO_2$ mol % | Temperature Rise Rate °C./h | Primary Grain Size μm | Secondary Grain Size μm |
|---|---|---|---|---|---|---|
| Example 14 | 99 | 0.5 | 0.5 | 100 | 1.5 | 15 |
| Example 15 | 90 | 5 | 5 | 100 | 1.2 | 12 |
| Example 16 | 85 | 10 | 5 | 100 | 0.7 | 11 |
| Example 17 | 80 | 15 | 5 | 100 | 0.3 | 7 |
| Example 18 | 75 | 20 | 5 | 100 | 0.2 | 9 |
| Example 19 | 70 | 25 | 5 | 100 | 0.2 | 7 |
| Example 20 | 65 | 30 | 5 | 100 | 0.2 | 8 |
| Example 21 | 85 | 5 | 10 | 100 | 0.8 | 9 |
| Example 22 | 80 | 10 | 10 | 100 | 0.5 | 8 |
| Example 23 | 70 | 20 | 10 | 100 | 0.3 | 7 |
| Example 24 | 80 | 5 | 15 | 100 | 0.7 | 9 |

TABLE 3

| | Resistivity Ω cm | Resistance Ω | Heat Capacity J/cm$^3$K | Heat Capacity Ratio to Comparative Example % | Rate of Change in Resistivity % |
|---|---|---|---|---|---|
| Example 14 | 144 | 3.22 | 2.75 | 72 | −15 |
| Example 15 | 223 | 4.99 | 2.80 | 72 | −13 |
| Example 16 | 450 | 10.1 | 2.85 | 70 | −12 |
| Example 17 | 830 | 18.6 | 2.90 | 69 | −10 |
| Example 18 | 1860 | 41.6 | 2.95 | 68 | −7 |
| Example 19 | 4390 | 98.3 | 3.00 | 67 | −5 |
| Example 20 | 6010 | 134 | 3.05 | 66 | −6 |
| Example 21 | 396 | 8.86 | 2.80 | 71 | −13 |
| Example 22 | 532 | 11.9 | 2.85 | 70 | −11 |
| Example 23 | 1210 | 27.1 | 2.95 | 88 | −9 |
| Example 24 | 4240 | 94.9 | 2.81 | 71 | −12 |

As is apparent from Table 3, the resistors of Examples 14 to 24 have preferable characteristics as in Example 13.

EXAMPLE 25

A zinc oxide (ZnO) powder having an average grain size of 0.2 μm, a nickel oxide (NiO) powder having an average grain size of 0.4 μm, and an anatase titanium oxide ($TiO_2$) powder having an average grain size of 0.2 μm were weighed at a mol rate of ZnO : NiO : $TiO_2$=75 : 15 : 10. The source powders were mixed in a wet state for 24 hours together with distilled water by a zirconia ball mill. The distilled water was removed, and the resultant powder mixture was screened. Thereafter, 7 wt. % of a 5% PVA aqueous solution were added to the powder mixture, and the powder mixture was screened again to form a granulated powder. This granulated powder was molded by a metal mold at a pressure of 500 kg/cm$^2$ to obtain a disk-like molded body having a diameter of 140 mm and a height of 30 mm. This molded body was heated at a temperature of 500° C. in the air for 24 hours to remove a binder, thereby obtaining a degreased body. The degreased body was placed in a box formed by a magnesium oxide sintered body covered with a magnesium oxide powder, and calcined in the air. As a temperature profile, a temperature was increased at a rate of 100° C./hour, a temperature of 1,300° C. was kept for 2 hours, and the temperature was decreased to room temperature at a rate of 100° C./hour. The sintered body had a diameter of 120 mm and a height of 25 mm. In addition, the sheet resistance of a high-resistance layer of the surface of the sintered body was $10^7$ Ω/□ or more.

After the outer peripheral surface of the sintered body was coated with a borosilicate glass powder, the powder was baked to form an insulating layer. Thereafter, the upper and lower surfaces of the sintered body were polished. After the sintered body was washed, aluminum electrodes were formed on the upper and lower surfaces by flame spraying, thereby manufacturing the resistor shown in FIG. 5.

In the resultant resistor, a relative density was 98.0%, a resistivity at room temperature was 730 Ω.cm ±20 Ω.cm, a resistance was 16.4±0.5 Ω, a temperature coefficient of resistance was +0.38%/deg, a heat capacity was 2.90±0.4 J/cc.deg, and an energy breakdown was 780 J/cm$^3$. The resistor had a breakdown voltage of 16 kV/cm or more as an impulse.

Control 1

After a degreased body was manufactured in the same procedures as those of Example 13, the degreased body was placed in a box made of aluminum oxide, and it was calcined in the air without being covered with a magnesium oxide powder. The same temperature profile as that of Example 13 was set. The obtained sintered body had the same size as Example 13 and a sheet resistance of $10^5$ Ω/□.

After the outer peripheral surface of the sintered body was coated with a borosilicate glass powder, the powder was baked to form an insulating layer. Thereafter, the upper and lower surfaces of the sintered body were polished. After the sintered body was washed, aluminum electrodes were formed on the upper and lower surfaces by flame spraying, thereby manufacturing a resistor.

In the resultant resistor, a relative density was 98.0%, a resistivity at room temperature was 730 Ω.cm ±20 Ω.cm, a resistance was 16.4±0.5 Ω, a temperature coefficient of resistance was +0.38%/deg, a heat capacity was 2.90±0.4 J/cc deg, and an energy breakdown was 780 J/cm$^3$. The resistor had an impulse breakdown voltage of 12 kV/cm at most, and the value was smaller than that of the resistor of Example 13 by 25%.

EXAMPLE 26

A zinc oxide (ZnO) powder having an average grain size of 0.7 μm, a nickel oxide (NiO) powder having an average grain size of 0.5 μm, and a titanium oxide ($TiO_2$) powder having an average grain size of 0.7 μm were weighed at a mol rate of ZnO : NiO : $TiO_2$=75 : 15 : 10. These powders were mixed to prepare a powder mixture. 1,000 g of the powder mixture were mixed with 460 mg of a $ZnF_2.4H_2O$ aqueous solution, and the resultant mixture was mixed by a zirconia ball mill in a wet state for 24 hours, and the obtained slurry was dried and screened. Thereafter 3 wt. % of a 5% PVA aqueous solution were added to the powder mixture, and the powder mixture was screened again to form a granulated powder. This granulated powder was molded by a metal mold at a pressure of 600 kg/cm$^2$ to obtain an annular molded body having an outer diameter of 140 mm, an inner diameter of 40 mm and a height of 30 mm. This molded body was placed in a sheath formed by a magnesium oxide sintered body and was calcined in the air. This calcining was performed under the following temperature profile. That is, a temperature was increased at a rate of 100° C./hour, a temperature of 1,300° C. was kept for 2 hours, and the temperature was decreased to room temperature in a furnace for 8 hours. The sintered body had an outer diameter of 127 mm, an inner diameter of 37 mm and a height of 25.4 mm.

After the outer peripheral surface of the sintered body was coated with a borosilicate glass powder, the powder was baked to form an insulating layer. Thereafter, the upper and lower surfaces of the sintered body were polished. After the sintered body was washed, aluminum electrodes were formed on the upper and lower surfaces by flame spraying, thereby manufacturing a resistor having a structure shown in FIG. 3 or 4.

COMPARATIVE EXAMPLE 2

A resistor was manufactured by forming a sintered body and electrodes following the same procedures as in Example 26 except that a powder mixture obtained by weighing powders at a ratio of ZnO : NiO : $TiO_2$=75 : 15 : 10 was used as a source powder and that a slurry was prepared in a wet state using distilled water in place of a $ZnF_2.4H_2O$ aqueous solution.

EXAMPLE 27-33

A mixing rate of a zinc oxide (ZnO) powder having an average grain size of 0.7 μm, a nickel oxide (NiO) powder having an average grain size of 0.5 μm, a titanium oxide ($TiO_2$) powder having an average grain size of 0.7 μm was, and a halide changed as shown in Table 4, and 7 types of resistors having sintered bodies of various compositions were manufactured. Note that the compositions of the sintered bodies of Example 26 and Comparative Example 2 are also summarized in Table 4.

TABLE 4

| | Content of ZnO mol % | Content of NiO mol % | Content of $TiO_2$ mol % | Halide (Values in Parentheses Represent Content in mg) | |
|---|---|---|---|---|---|
| 26 | 69 | 22 | 9 | $ZnF_2.4H_2O$ | (460) |
| 27 | 69 | 22 | 9 | $NiF_2$ | (100) |
| 28 | 80 | 15 | 5 | $TiOF_2$ | (100) |
| 29 | 69 | 22 | 9 | $AlF_3$ | (100) |
| 30 | 85 | 5 | 10 | $NH_4HF_2$ | (100) |
| 31 | 69 | 22 | 9 | $ZnCl_2$ | (100) |
| 32 | 69 | 22 | 9 | $I_2$ | (100) |
| 33 | 69 | 22 | 9 | $ZnF_2.4H_2O$ | (46) |
| Comparative Example 2 | 69 | 22 | 9 | — | |

The concentration distributions of halogens in Example 26 and Comparative Example 2 were measured. The results were shown in FIG. 12.

In each of the resistors of Examples 26 to 33 and Comparative Example 2, a specific heat, a resistivity at room temperature, and a resistivity deviation were measured. The obtained values are shown in Table 5. The resistivity at room temperature was measured in the same manner as described in Example 1. The specific heat was measured as follows. That is, a 2 mm wide thin piece obtained by cutting the sintered body perpendicularly the circle of the sintered body along the center line of the annular body was grounded and mixed, and the obtained powder was used as a sample. The specific heat was measured by a DSC-2 manufactured by Parkin Elmer Corp. at a temperature of 25° C. The resistivity deviation was measure as follows. That is, disks each having a diameter of 20 mm and a thickness of 2 mm were cut from the center of the disk-like sintered body and from the disk-like sintered body at a 1 mm inside the outer periphery, the resistances of the disks were measured, and a ratio of the resistances was used as the resistivity deviation. Each of the concentration distributions of halogen was obtained as follows. Small pieces each having dimensions of 1 mm×1 mm×2 mm were cut from the thin piece every 5 mm, and the concentration distribution of a total halogen amount was obtained by a chemical titration.

TABLE 5

| | Specific Heat | Resistivity at Room Temperature Ωcm | Resistivity Deviation % |
|---|---|---|---|
| Example 26 | 2.97 | 2500 | 0.30 |
| Example 27 | 2.97 | 2230 | 0.90 |
| Example 28 | 2.90 | 2150 | 0.27 |
| Example 29 | 2.96 | 2400 | 1.20 |
| Example 30 | 2.80 | 1320 | 0.95 |
| Example 31 | 2.97 | 1990 | 0.72 |
| Example 32 | 2.95 | 1420 | 4.80 |
| Example 33 | 2.98 | 1470 | 2.70 |
| Comparative Example 2 | 2.97 | 1350 | 5.00 |

EXAMPLE 34

A zinc oxide (ZnO) powder having an average grain size of 0.2 μm, a nickel oxide (NiO) powder having an average grain size of 0.4 μm, and an anatase titanium oxide ($TiO_2$) powder having an average grain size of 0.2 μm were weighed at a mol rate of ZnO : NiO : $TiO_2$=75 : 15 : 10. The source powders were mixed in a wet state for 24 hours using a resin ball mill and a zirconia ball mill. After the distilled water was removed, 7 wt. % of a 5% PVA aqueous solution were added to the powder mixture, and the powder mixture was screened to form a granulated powder. This granulated powder was molded by a metal mold at a pressure of 500 kg/cm$^2$ to obtain a disk-like molded body having a diameter of 148 mm and a height of 32 mm. This molded body was heated at a temperature of 500° C. in the air for 24 hours to remove a binder, thereby obtaining a degreased body. The degreased body was placed in a box made of a magnesium oxide sintered body and was calcined in the air. The calcining was performed under the following temperature profile. That is, a temperature was increased at a rate of 100° C./hour, a temperature of 1,400° C. was kept for 2 hours, and the temperature of 1,300° C. was rapidly decreased by furnace cooling. The sintered body had a diameter of 127 mm and a height of 25.4 mm.

After the outer peripheral surface of the sintered body was coated with a borosilicate glass powder, the powder was baked to form an insulating layer. Thereafter, the upper and lower surfaces of the sintered body were polished. After the sintered body was washed, aluminum electrodes were formed on the upper and lower surfaces by flame spraying, thereby manufacturing a resistor having the structure shown in FIG. 5.

EXAMPLES 35-49 AND CONTROLS 2-5

Figure 5:
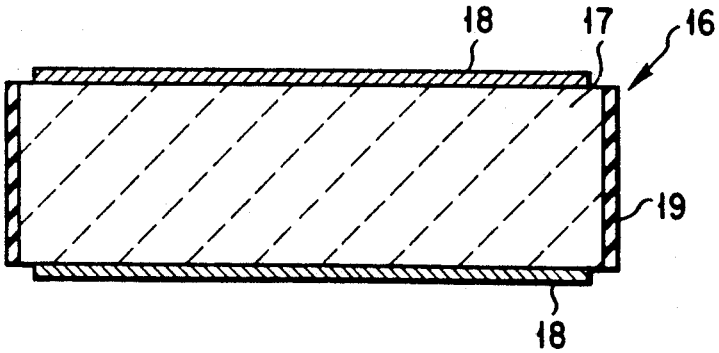

A zinc oxide (ZnO) powder having an average grain size of 0.2 μm, a nickel oxide (NiO) powder having an average grain size of 0.4 μm, and an anatase titanium oxide ($TiO_2$) powder having an average grain size of 0.2 μm were mixed at the molar ratios shown in Table 6, and 19 types of source powders were prepared. 19 types of resistors each having the structure shown in FIG. 5 were manufactured following the same procedures as in Example 34 except that the above source powders were used and that calcining temperatures, rise rates, and rapid cooling temperatures described in Table 6 were used as conditions. Note that the source composition and calcining conditions of the sintered body of Example 34 are also summarized in Table 6.

TABLE 6

| | ZnO mol % | NiO mol % | $TiO_2$ mol % | Calcining Temperature °C. | Temperature Drop Rate °C./h | Cooling Temperature °C. |
|---|---|---|---|---|---|---|
| Control 2 | 80 | 5 | 15 | 1400 | 100 | 1300 |
| Example 34 | 80 | 5 | 15 | 1400 | 100 | 1200 |
| Example 35 | 80 | 5 | 15 | 1400 | 100 | 1100 |
| Example 36 | 80 | 5 | 15 | 1400 | 100 | 1000 |
| Example 37 | 80 | 5 | 15 | 1400 | 100 | 900 |
| Example 38 | 80 | 5 | 15 | 1300 | 100 | 900 |
| Example 39 | 80 | 5 | 15 | 1200 | 100 | 900 |
| Example 40 | 90 | 5 | 5 | 1400 | 100 | 1200 |
| Example 41 | 90 | 5 | 5 | 1400 | 100 | 1100 |
| Example 42 | 90 | 5 | 5 | 1400 | 100 | 1000 |
| Example 43 | 90 | 5 | 5 | 1400 | 100 | 900 |
| Control 3 | 90 | 5 | 5 | 1400 | 100 | 800 |
| Example 44 | 90 | 5 | 5 | 1400 | 300 | 1000 |
| Example 45 | 90 | 5 | 5 | 1400 | 200 | 1000 |
| Example 46 | 90 | 5 | 5 | 1400 | 50 | 1000 |
| Example 47 | 90 | 5 | 5 | 1400 | 20 | 1000 |
| Control 4 | 90 | 5 | 5 | 1400 | 10 | 1000 |
| Example 48 | 85 | 5 | 10 | 1400 | 100 | 1200 |
| Example 49 | 88 | 5 | 7 | 1400 | 100 | 1200 |
| Control 5 | 92 | 5 | 3 | 1400 | 100 | 1200 |

The contents of the $TiO_2$ solid solutions of the sintered bodies manufacture din Examples 34 to 49 and Controls 2 to 5 were measured. Each sintered body was ground to obtain a powder sample, and 50 ml of a mixed solution containing 5% acetic acid and 5% lactic acid were added to 1 g of the sample. After Zn grains were dissolved while an ultrasonic wave was applied to the sample for 90 minutes, the dissolved grains were filtered with a filter, and titanium was quantitatively measured by an ICP emission spectroscopy. In each of the resistors of Examples 34 to 49 and Controls 2 to 5, a resistivity at room temperature, a temperature coefficient of resistance, and a rate of a change in resistance were measured. Note that the temperature coefficient of resistance was evaluated in the same method as described in Example 1. The rate of change in resistance was obtained such that a change in resistance obtained when a shock wave corresponding to 200 J/cm$^3$ was applied 20 times to a sample cut from each of the resistors was obtained as percentage to an initial value. These resultant values are summarized in Table 7.

TABLE 7

| | $TiO_2$ Solid Solution Amount mol % | Resistivity Ω · cm | Temperature Coefficient of Resistance %/deg | Resistance change Rate % |
|---|---|---|---|---|
| Control 2 | 0.120 | 1730 | 0.55 | −16 |
| Example 34 | 0.090 | 1750 | 0.35 | −8 |
| Example 35 | 0.080 | 1770 | 0.30 | −6 |
| Example 36 | 0.080 | 1780 | 0.27 | −5 |
| Example 37 | 0.070 | 1800 | 0.25 | −7 |
| Example 38 | 0.050 | 2100 | 0.35 | −7 |
| Example 39 | 0.040 | 2950 | 0.42 | −8 |
| Example 40 | 0.015 | 530 | 0.25 | −5 |
| Example 41 | 0.013 | 550 | 0.25 | −7 |
| Example 42 | 0.009 | 570 | 0.12 | −6 |
| Example 43 | 0.007 | 590 | 0.03 | −8 |
| Control 3 | 0.003 | 650 | −0.45 | −14 |
| Example 44 | 0.014 | 530 | 0.26 | −6 |
| Example 45 | 0.011 | 570 | 0.27 | −6 |
| Example 46 | 0.007 | 580 | 0.15 | −5 |
| Example 47 | 0.005 | 630 | 0.02 | −9 |
| Control 4 | 0.002 | 670 | −0.41 | −17 |
| Example 48 | 0.060 | 1240 | 0.34 | −7 |
| Example 49 | 0.020 | 830 | 0.28 | −7 |
| Control 5 | 0.003 | 260 | −0.31 | −19 |

A power resistor (closing resistor) requires the following values. That is, a resistivity is $10^2$ to $10^4$ Ω.cm, a temperature coefficient of resistance has a positive value and an absolute value of 0.5% or less, and a rate of change in resistance caused by surge absorption is 10% or less. According to Table 7, each of the resistors of Examples 34 to 49 has a positive temperature coefficient of resistance, an absolute value thereof smaller than that of each of the resistors of Controls 2 to 5, and a rate of change in resistance caused by repetitive surge application which is smaller than that of each of the resistors of Controls 2 to 5. Each of the resistors of Examples 34 to 49 has a sintered body containing 0.005 to 0.1 mol. % of $TiO_2$ dissolved in zinc oxide grains as a solid solution, and each of the resistors of Controls 2 to 5 has a sintered body containing a $TiO_2$ in an amount which falls outside the above range.

As described above, according to the present invention, there is provided a power circuit breaker including a closing resistor unit having a large heat capacity. The power circuit breaker can absorb a large switching surge and has dimensions smaller than those of a power circuit breaker which can absorb the same switching surge. In addition, the closing resistor unit has a small temperature coefficient, and the power circuit breaker of the present invention has stability to repetitive energy application.

According to the present invention, a power resistor having a heat capacity per unit volume, a small change in resistivity caused by a change in temperature, and a small change in resistivity even when the resistor is repetitively used. Therefore, the dimensions of the resistor can be considerably decreased compared with a conventional resistor, and the dimensions of a circuit breaker in which the resistor is incorporated can be decreased. In addition, when the circuit breaker is applied to other power equipments such as an NGR and a motor control resistor, the dimensions of these equipments can be decreased.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A power circuit breaker comprising:

a main switching means having an arc extinguishing function;

auxiliary switching means connected in parallel to said main switching means and having an arc extinguishing function; and a closing resistor unit connected in series with said auxiliary switching means; and wherein said closing resistor unit contains a resistor comprising zinc oxide, and titanium oxide in an amount of 0.5 to 25 mol. % and nickel oxide in an amount of 0.5 to 30 mol. %.

2. A breaker according to claim 1, wherein said resistor includes a sintered body and electrodes formed on at least upper and lower surfaces of said sintered body, said sintered body containing zinc oxide, and titanium oxide in an amount of 0.5 to 25 mol. % and nickel oxide in an amount of 0.5 to 30 mol. %, said sintered body having a broken surface formed by grains having an average grain size of 3 to 15 μm, and said sintered body having grain structure constituted by an aggregate of a plurality of grains.

3. A breaker according to claim 1, wherein said resistor includes a sintered body and electrodes formed on at least upper and lower surfaces of said sintered body, said sintered body containing zinc oxide, and titanium oxide in an amount of 0.5 to 25 mol. % and nickel oxide in an amount of 0.5 to 30 mol. %, and said sintered body having a surface formed by a Spinel phase of $(Zn_xNi_{1-x})_2TiO_4$ ($0 \leqq X \leqq 1$).

4. A breaker according to claim 1, wherein said resistor includes a sintered body and electrodes formed on at least upper and lower surfaces of said sintered body, said sintered body containing zinc oxide, and titanium oxide in an amount of 0.5 to 25 mol. % and nickel oxide in an amount of 0.5 to 30 mol. %, the titanium oxide in an amount of 0.005 to 0.1 mol. % being dissolved in grains of the zinc oxide as a solid solution.

5. A breaker according to claim 1, wherein said resistor includes a sintered body and electrodes formed on at least upper and lower surfaces of said sintered body, said sintered body containing zinc oxide, titanium oxide in an amount of 0.5 to 25 mol. % and nickel oxide in an amount of 0.5 to 30 mol. %, and 0.01 ppm to 1% by weight of a halogen, Ni being dissolved in ZnO or ZnO and $Zn_2TiO_4$ as a solid solution.

6. A power resistor comprising:

a sintered body containing zinc oxide, and titanium oxide in an amount of 0.5 to 25 mol. % and nickel oxide in an amount of 0.5 to 30 mol. %, said sintered body having surface formed by a Spinel phase of $(Zn_XNi_{1-X})_2TiO_4$ ($0 \leqq X \leqq 1$); and electrodes formed on at least upper and lower surfaces of said sintered body.

7. A resistor according to claim 6, wherein said sintered body contains titanium oxide in an amount of 1 to 20 mol. % and nickel oxide (NiO) in an amount of 1 to 25 mol. %.

8. A resistor according to claim 6, wherein said sintered body contains 0.01 ppm. to 1% by weight of a halogen, and the Ni is dissolved in the ZnO or the ZnO and $Zn_2TiO_4$ as a solid solution.

9. A power resistor comprising:

a sintered body containing zinc oxide, and titanium oxide in an amount of 0.5 to 25 mol. % and nickel oxide in an amount of 0.5 to 30 mol. %, the titanium oxide in an amount of 0.005 to 0.1 mol. % being dissolved in grains of the zinc oxide as a solid solution; and electrodes formed on at least upper and lower surfaces of said sintered body.

10. A resistor according to claim 9, wherein said sintered body contains titanium oxide in an amount of 1 to 20 mol. % and nickel oxide in an amount of 1 to 25 mol. %.

11. A resistor according to claim 9, wherein said sintered body contains the titanium oxide in an amount of 0.01 to 0.08 mol. %, which is dissolved in grains of the zinc oxide as a solid solution.

12. A resistor according to claim 9, wherein said sintered body contains 0.01 ppm. to 1% by weight a halogen, and the Ni is dissolved in the ZnO or the ZnO and $Zn_2TiO_4$ as a solid solution.

13. A power circuit breaker including a main switching means, an auxiliary switching means connected in parallel to said main switching means, and a closing resistor unit connected in series with said auxiliary switching means, the improvement comprising a closing resistor unit containing a resistor comprising zinc oxide, titanium oxide in an amount of 0.5 to 25 mol. %, and nickel oxide in an amount of 0.5 to 30 mol. %.

* * * * *